US011476570B2

(12) United States Patent
Tsumura et al.

(10) Patent No.: US 11,476,570 B2
(45) Date of Patent: Oct. 18, 2022

(54) ANTENNA APPARATUS

(71) Applicant: PANASONIC INTELLECTUAL PROPERTY MANAGEMENT CO., LTD., Osaka (JP)

(72) Inventors: Koichi Tsumura, Kanagawa (JP); Toshihiro Okuda, Tokyo (JP); Yuki Iida, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 157 days.

(21) Appl. No.: 16/830,949

(22) Filed: Mar. 26, 2020

(65) Prior Publication Data

US 2020/0313291 A1 Oct. 1, 2020

(30) Foreign Application Priority Data

Mar. 28, 2019 (JP) ..... JP2019-064965

(51) Int. Cl.
*H01Q 1/48* (2006.01)
*H01Q 21/06* (2006.01)

(52) U.S. Cl.
CPC ..... *H01Q 1/48* (2013.01); *H01Q 21/06* (2013.01)

(58) Field of Classification Search
CPC ..... H01Q 21/06–28; H01Q 21/062; H01Q 25/005; H01Q 21/00; H01Q 1/48; H01Q 9/26; H01Q 21/26
See application file for complete search history.

(56) References Cited

U.S. PATENT DOCUMENTS

| | | | | |
|---|---|---|---|---|
| 10,535,917 | B1 * | 1/2020 | Lalezari | H01Q 1/523 |
| 2007/0080878 | A1 * | 4/2007 | McLean | H01Q 13/106 343/725 |
| 2013/0082893 | A1 * | 4/2013 | Wang | H01Q 9/26 343/810 |
| 2018/0183132 | A1 | 6/2018 | Wong et al. | |

FOREIGN PATENT DOCUMENTS

| | | |
|---|---|---|
| JP | 2010-130115 | 6/2010 |
| JP | 2015-111763 A | 6/2015 |
| JP | 2018-107783 A | 7/2018 |

OTHER PUBLICATIONS

Notice of Reasons for Rejection (English Language Translation), dated May 24, 2022, for the corresponding Japanese Patent Application No. 2019-064965.
Decision of Refusal (English Language Translation), dated Aug. 23, 2022, on the corresponding Japanese Patent Application No. 2019-064965.

* cited by examiner

*Primary Examiner* — Ricardo I Magallanes
(74) *Attorney, Agent, or Firm* — Greenblum & Bernstein, P.L.C.

(57) ABSTRACT

An antenna apparatus capable of being downsized while preventing performance degradation is provided. Antenna apparatus includes: first antenna; second antenna; first ground plane to which first antenna is connected via first power feeder; and second ground plane to which second antenna is connected via second power feeder. In antenna apparatus, first ground plane and second ground plane are provided substantially in parallel with each other.

16 Claims, 5 Drawing Sheets

| No. | GROUND PLANE SIZE W(mm) × L(mm) | DISTANCE BETWEEN GROUND PLANES D(mm) | CORRELATION COEFFICIENT IMPROVEMENT | FIRST ANTENNA EFFICIENCY IMPROVEMENT (dB) | SECOND ANTENNA EFFICIENCY IMPROVEMENT (dB) |
|---|---|---|---|---|---|
| 1 | 25 x 70 | 2≦D≦16 | 0.01～0.07 | 0.5～3.9 | 0.7～2.4 |
| 2 | 25 x 90 | 2≦D≦16 | 0.00～0.08 | 0.5～2.7 | 0.6～1.9 |
| 3 | 35 x 70 | 2≦D≦12 | 0.01～0.11 | 0.4～1.7 | 0.0～1.0 |
| 4 | 35 x 90 | 2≦D≦12 | 0.02～0.12 | 0.3～1.2 | 0.3～0.8 |
| 5 | 45 x 70 | 2≦D≦8 | 0.02～0.10 | 0.2～0.8 | 0.0～0.4 |
| 6 | 45 x 90 | 2≦D≦8 | 0.03～0.08 | 0.2～0.5 | 0.2～0.3 |
| 7 | 55 x 70 | 2≦D≦6 | 0.03～0.09 | 0.1～0.3 | 0.0～0.1 |
| 8 | 55 x 90 | 2≦D≦6 | 0.02～0.03 | 0.1～0.2 | 0.1～0.2 |

ANTENNA APPARATUS

TECHNICAL FIELD

The present disclosure relates to an antenna apparatus.

BACKGROUND ART

Conventionally, as one of techniques for improving communication speeds in radio systems, a technique of Multiple Input Multiple Output (MIMO) for performing communication using a plurality of antennas has been known.

For example, Patent Literature (hereinafter, referred to as "PTL") 1 discloses a MIMO antenna apparatus including a rectangular board, two inverted-F antennas disposed on one short side of the board, and two slit-type monopole antennas disposed respectively on both long sides of the board.

CITATION LIST

Patent Literature

PTL 1 Japanese Patent Application Laid-Open No. 2010-130115

SUMMARY OF INVENTION

Technical Problem

An object of the present disclosure is to provide an antenna apparatus capable of being downsized while preventing performance degradation.

Solution to Problem

An antenna apparatus according to one aspect of the present disclosure includes a first antenna; a second antenna; a first ground plane to which the first antenna is connected via a first power feeder; and a second ground plane to which the second antenna is connected via a second power feeder, in which the first ground plane and the second ground plane are provided substantially in parallel with each other.

Advantageous Effects of Invention

According to the present disclosure, it is made possible to provide an antenna apparatus capable of being downsized while preventing performance degradation.

DESCRIPTION OF EMBODIMENTS

Hereinafter, an embodiment of the present disclosure will be described in detail with reference to the accompanying drawings.

Figure 1A:
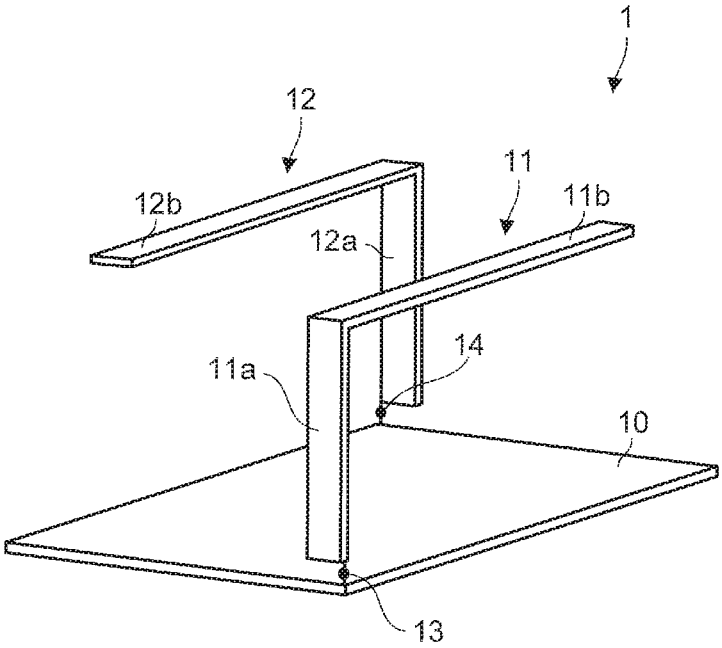
FIG. 1A is a diagram illustrating a configuration example of an antenna apparatus with one ground plane.
Figure 1B:
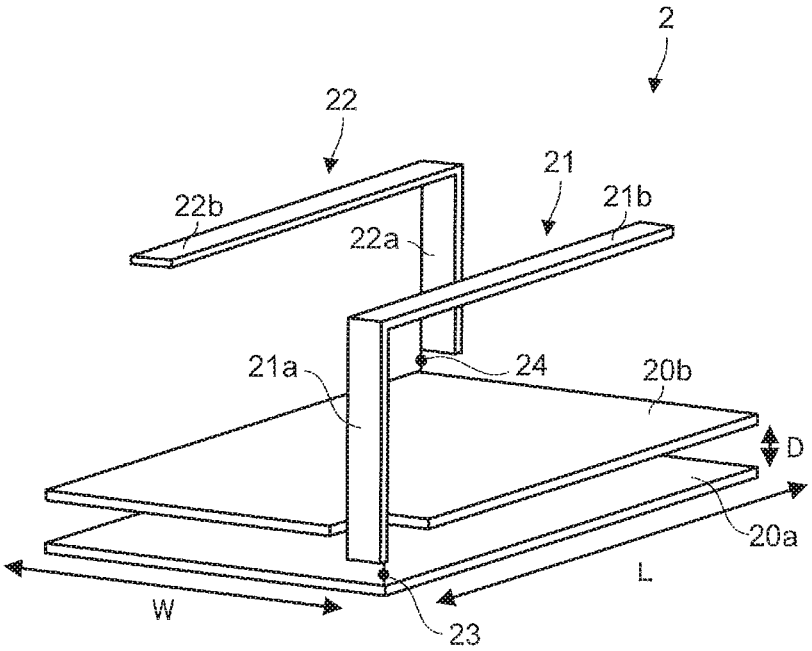
FIG. 1B is a diagram illustrating a configuration example of an antenna apparatus with two ground planes.

FIG. 1A is a diagram illustrating a configuration example of antenna apparatus 1 with one ground plane, and FIG. 1B is a diagram illustrating a configuration example of antenna apparatus 2 with two ground planes, according to the present embodiment.

Antenna apparatus 1 illustrated in FIG. 1A includes ground plane 10, first antenna 11, and second antenna 12.

First antenna 11 is an inverted-L antenna and includes first element 11*a* extending perpendicularly with respect to ground plane 10 of a rectangular shape, and second element 11*b* extending along a long side of ground plane 10.

First antenna 11 is connected to a corner portion of ground plane 10 via first power feeding point 13.

Second antenna 12 is also an inverted-L antenna and includes third element 12*a* extending perpendicularly with respect to ground plane 10 on the same side as first element 11*a* of first antenna 11, and fourth element 12*b* extending along the long side of ground plane 10.

Further, second antenna 12 is connected via second power feeding point 14 to a corner portion of ground plane 10 which is positioned diagonally to the corner portion where first power feeding point 13 is positioned.

The direction in which fourth element 12*b* of second antenna 12 extends from third element 12*a* is opposite to the direction in which second element 11*b* of first antenna 11 extends from first element 11*a*.

Second element 11*b* of first antenna 11 is provided so as to be positioned at the same height as fourth element 12*b* of second antenna 12 as viewed from ground plane 10.

Meanwhile, antenna apparatus 2 according to the present embodiment illustrated in FIG. 1B includes first ground plane 20*a*, second ground plane 20*b*, first antenna 21, and second antenna 22.

First ground plane 20*a* and second ground plane 20*b*, herein, are provided in parallel with each other. Note that, provision of first ground plane 20*a* and second ground plane 20*b* strictly in parallel with each other is not necessarily required for obtaining the operational effects of the present disclosure, and obviously, a certain error is tolerable.

That is, it is sufficient as long as first ground plane 20*a* and second ground plane 20*b* are provided substantially in parallel with each other. In other words, this means that first ground plane 20*a* and second ground plane 20*b* extend substantially in the same direction. Further, the shapes of first ground plane 20*a* and second ground plane 20*b* need not be the shapes which completely overlap each other.

First antenna 21 is an inverted-L antenna and includes first element 21*a* extending perpendicularly with respect to first ground plane 20*a* of a rectangular shape and second element 21*b* extending along a long side of first ground plane 20*a*.

Further, first antenna 21 is connected to a corner portion of first ground plane 20*a* via first power feeding point 23.

Herein, a notch is formed in second ground plane 20*b* for the purpose of achieving downsizing of antenna apparatus 2 by extending first element 21*a* perpendicularly with respect to first ground plane 20*a* without causing first element 21*a* to protrude outward.

Second antenna 22 is also an inverted-L antenna and includes third element 22*a* extending perpendicularly with respect to first ground plane 20*a* on the same side as first element 21*a* of first antenna 21, and fourth element 22*b* extending along a long side of second ground plane 20*b*.

Second antenna 22 is connected via second power feeding point 24 to a corner portion of second ground plane 20*b* which is positioned diagonally to a corner portion of first ground plane 20*a* where first power feeding point 23 is positioned.

The direction in which fourth element 22*b* of second antenna 22 extends from third element 22*a* is substantially opposite to the direction in which second element 21*b* of first antenna 21 extends from first element 21*a*.

Second element 21*b* of first antenna 21 is provided so as to be positioned at the same height as fourth element 22*b* of second antenna 22 as viewed from second ground plane 20*b*.

In antenna apparatus 1 illustrated in FIG. 1A, the two antennas (first antenna 11 and second antenna 12) are provided on one ground plane 10, thereby, causing antenna coupling to occur, and thus, causing a decrease in antenna efficiency and an increase in correlation coefficients.

In order to prevent the above described situation, it is possible to make ground plane 10 larger in size, but larger ground plane 10 makes downsizing of antenna apparatus 1 difficult.

Meanwhile, in antenna apparatus 2 illustrated in FIG. 1B, a configuration is adopted in which first antenna 21 and second antenna 22 are connected to the two ground planes (first ground plane 20*a* and second ground plane 20*b*) that are parallel to each other, via first power feeding point 23 and second power feeding point 24, respectively.

With this configuration, downsizing is made possible while degradation of antenna performance is prevented. Hereinafter, the antenna performance of antenna apparatus 2 according to the present embodiment will be described.

Figure 2A:
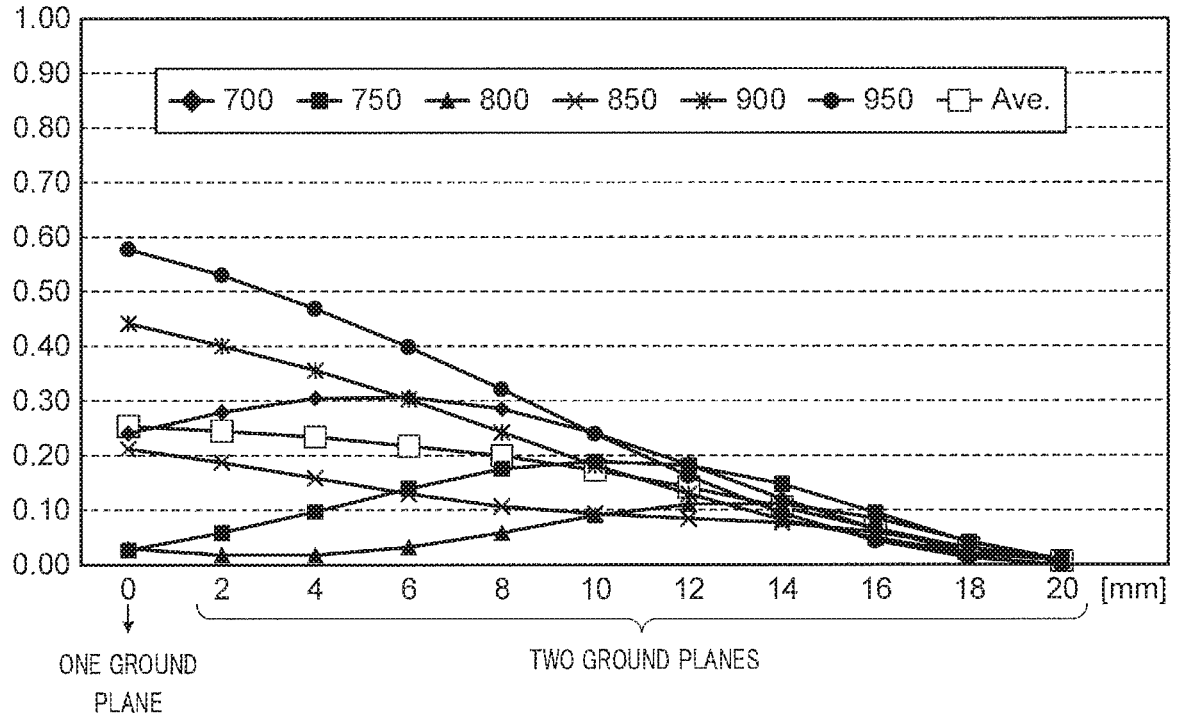
FIG. 2A is a diagram indicating a relationship between a distance between two ground planes and a correlation coefficient between antennas.
Figure 2B:
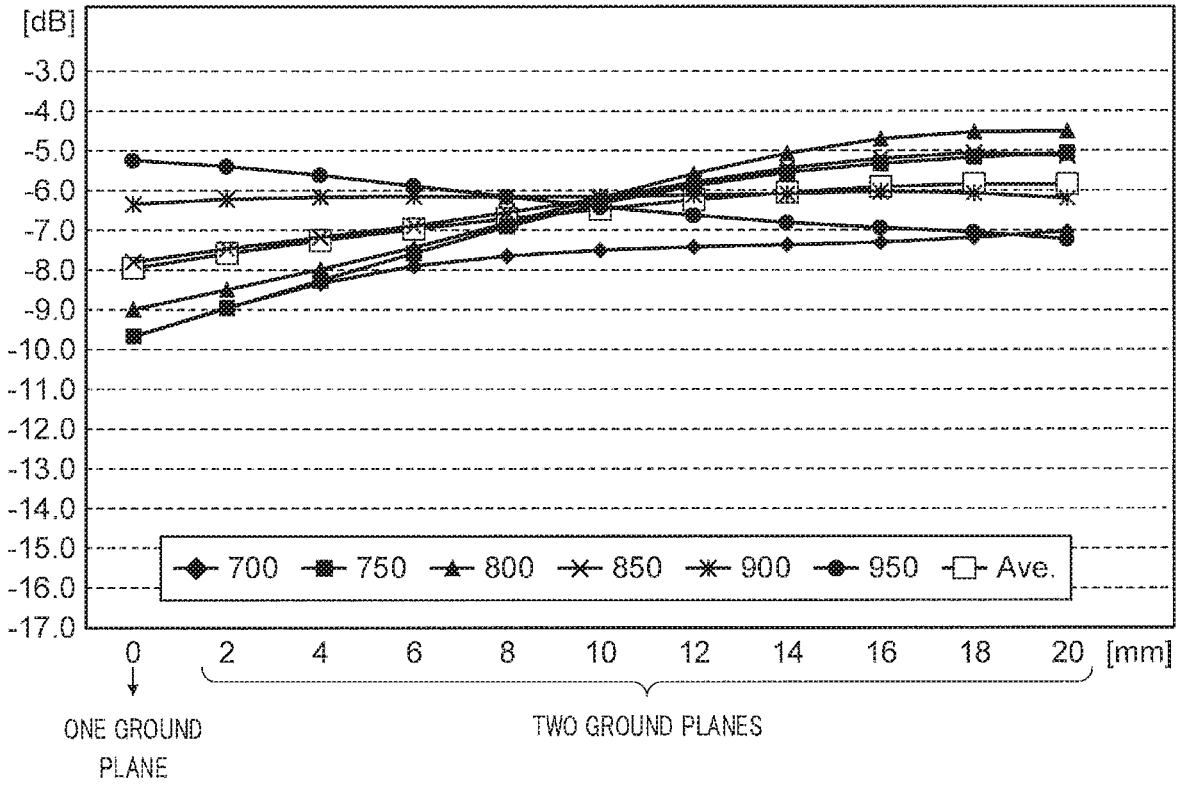
FIG. 2B is a diagram indicating a relationship between the distance between the two ground planes and an antenna efficiency of a first antenna.
Figures 2C, 3:
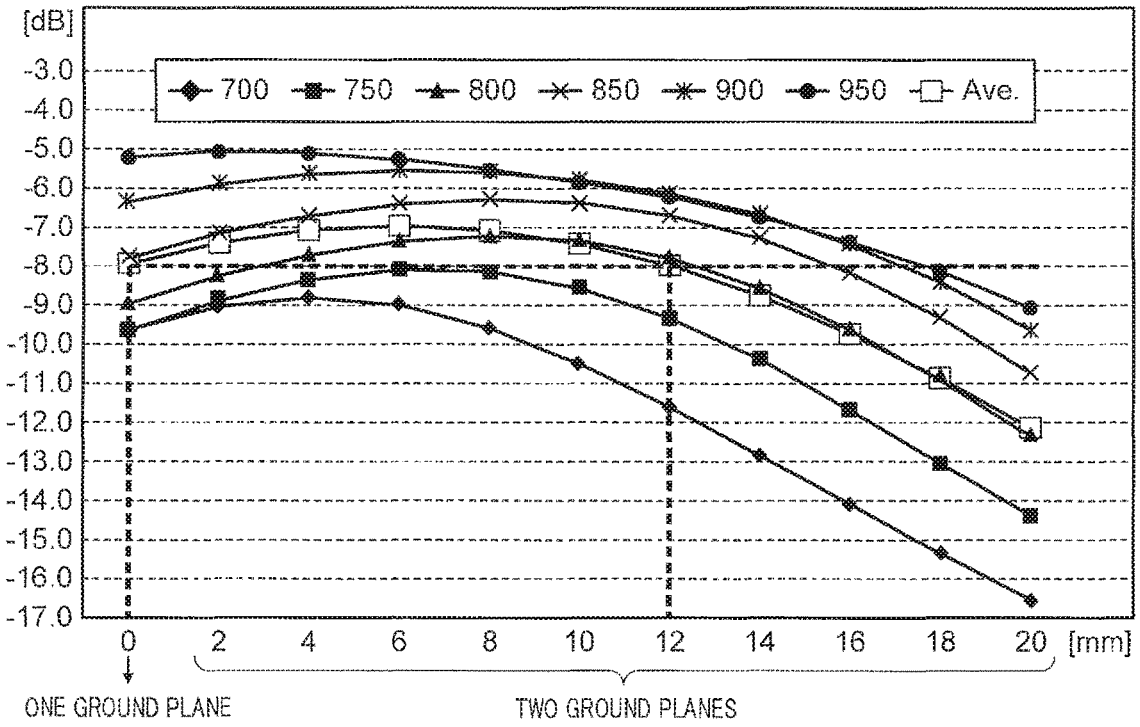
FIG. 2C is a diagram indicating a relationship between a distance between two ground planes and an antenna efficiency of a second antenna.
FIG. 3 is a diagram for describing a relationship between the distance between two ground planes and performance improvement.

FIG. 2A is a diagram indicating a relationship between a distance between the two ground planes and the correlation coefficient between the antennas. FIG. 2B is a diagram indicating a relationship between a distance between the two ground planes and the antenna efficiency of first antenna 21. FIG. 2C is a diagram indicating a relationship between a distance between the two ground planes and the antenna efficiency of second antenna 22.

FIG. 2A, FIG. 2B, and FIG. 2C indicate values of simulation results of correlation coefficients or antenna efficiency with respect to the distances between the ground planes (horizontal axis, in millimeters). Simulations are conducted for a plurality of frequencies (700, 750, 800, 850, 900, and 950 MHz), and FIGS. 2A, 2B, and 2C indicate the transition of values of the correlation coefficients or the antenna efficiency between the antennas with respect to the distance between the ground planes for each frequency, and further indicate their mean values.

Herein, 0 mm on the horizontal axis indicates that one ground plane is used. Further, the scale after 0 mm on the horizontal axis represents the distance between two ground planes, and the distance between first ground plane 20*a* and second ground plane 20*b* illustrated in FIG. 1B increases by 2 mm.

As illustrated in FIG. 2A, the correlation coefficient between the antennas decreases as the distance between the two ground planes increases, with reference to the mean values of the correlation coefficients. In other words, it can be said that the correlation coefficient between the antennas tends to improve as the distance between the two ground planes increases.

As illustrated in FIG. 2B, the antenna efficiency of first antenna 11 also increases as the distance between the two ground planes increases, with reference to the mean values of the antenna efficiency. That is, it can be said that the antenna efficiency of first antenna 11 tends to improve as the distance between the two ground planes increases.

Further, as illustrated in FIG. 2C, it can be said that the antenna efficiency of second antenna 12 exhibits substantially the same or even better performance than that of the case of one ground plane when the distance between the two ground planes is up to 12 mm, and the antenna efficiency tends to improve when the distance between ground planes is at least up to 12 mm.

As described above, the reason for the performance improvement in antenna apparatus 2 illustrated in FIG. 1B is that, since the antennas are respectively disposed on two ground planes provided in parallel with each other as illustrated in FIG. 1B, the symmetry of the current distributions and the radiation patterns of antenna apparatus 2 is broken as compared with the symmetry of the current distributions and the radiation patterns of antenna apparatus 1 illustrated in FIG. 1A.

Next, a description will be given of a relationship between the distance between first ground plane 20*a* and second ground plane 20*b* and the performance improvement in antenna apparatus 2 illustrated in FIG. 1B.

FIG. 3 is a diagram illustrating the relationship between the distance between first ground plane 20*a* and second ground plane 20*b* and the performance improvement in antenna apparatus 2.

FIG. 3 indicates the results of simulations conducted on eight antenna apparatuses 2 having different sizes.

More specifically, eight results of simulations are indicated, which are conducted while distance D between first ground plane 20*a* and second ground plane 20*b* is changed in a case where the lengths of the short sides of first ground plane 20*a* and second ground plane 20*b* are the same W, and the lengths of the long sides thereof are the same L.

The evaluation values of the improvement of the correlation coefficients, the efficiency improvement of first antenna 21, and the efficiency improvement of second antenna 22 in FIG. 3 are average values of bands from 700 MHz to 950 MHz. The evaluation values of the improvement of the correlation coefficients and the efficiency improvement are values representing the degree of the improvement with respect to the correlation coefficients or the efficiency in the case of one ground plane.

As illustrated in FIG. 3, it can be said that the correlation coefficients and the efficiency of first antenna 21 are improved in all of the eight antenna apparatuses having different sizes (except for correlation coefficient for 25×70), by adopting a configuration in which two ground planes are used, as compared with the case of one ground plane.

Further, the efficiency of second antenna 22 is not degraded (is slightly improved) as compared with the case of one ground plane.

Herein, it is regarded as a remarkable improvement in a case where a stable improvement is observed in correlation coefficients and there is a case where the efficiency of first antenna 21 exceeds 0.3 dB.

In this case, it can be said that remarkable improvements are present in the cases of No. 3 to No. 6 among the cases of No. 1 to No. 8 indicated in FIG. 3.

In these cases, when length L of the long sides of first ground plane 20*a* and second ground plane 20*b* is equal to or greater than 70 mm and is not greater than 90 mm, and the length W of the short sides of first ground plane 20*a* and second ground plane 20*b* is (25+t) mm (where t is equal to or greater than 10 and is not greater than 20), the distance between first ground plane 20*a* and second ground plane 20*b* is equal to or greater than 2 mm and is not greater than (16−2t/5) mm.

That is, it can be said that the antenna performance is remarkably improved when the conditions as described above are satisfied. For example, when W=35 mm and t=10, D is 12 mm or less, and when W=45 mm and t=20, D is 8 mm or less.

Note that, the cases described herein are only a description of dimensions with which a remarkable effect can be obtained when a configuration in which two ground planes are used is adopted, and obviously, a certain improvement effect can be obtained even when t is smaller than 10 or larger than 20 by adopting the configuration in which two ground planes are used.

Figure 4A:
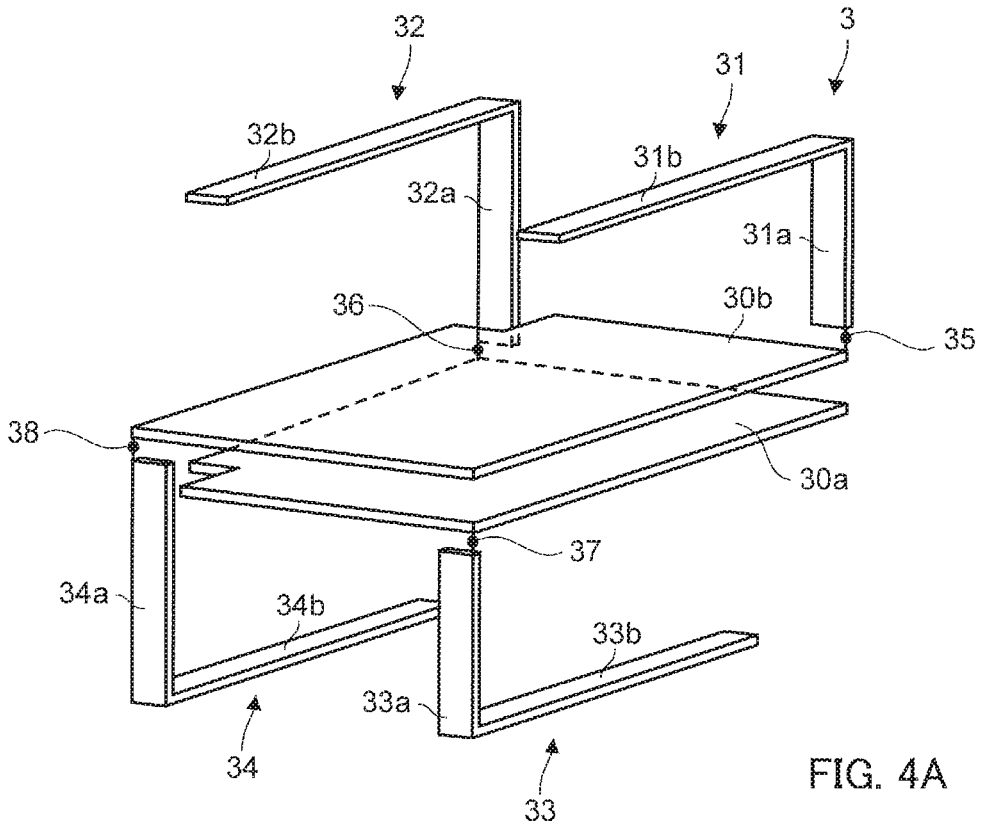
FIG. 4A is a diagram illustrating a configuration example of an antenna apparatus in a case where the number of antennas is four.
Figure 4B:
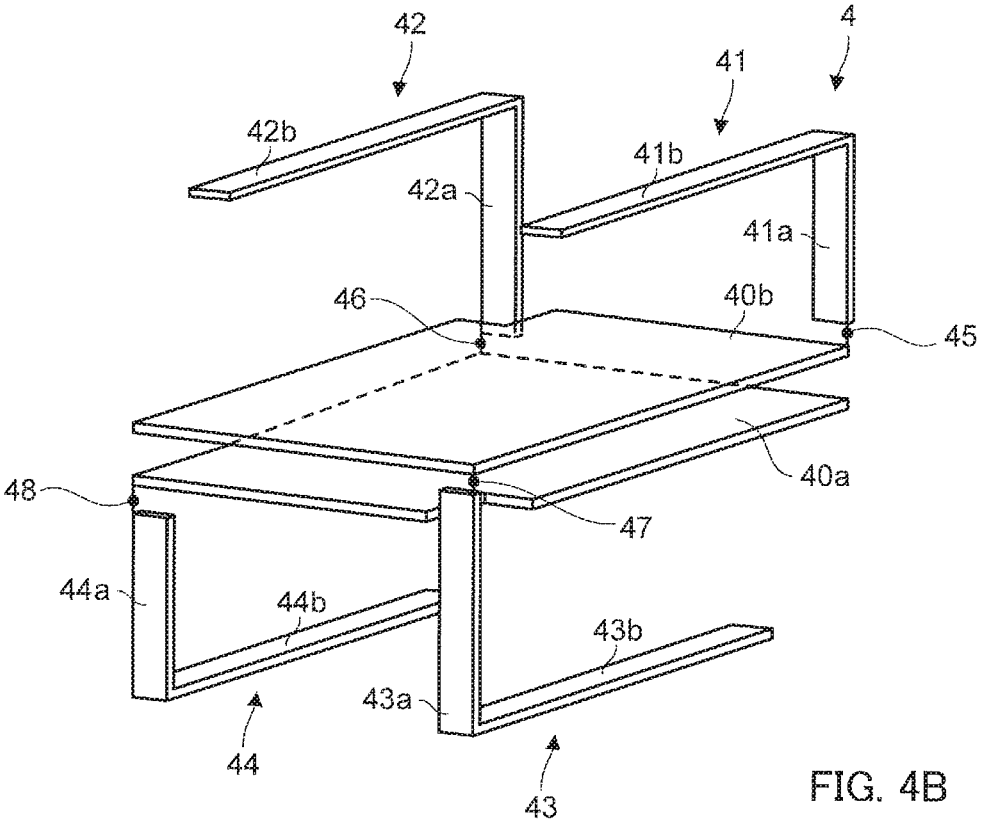
FIG. 4B is a diagram illustrating another configuration example of the antenna apparatus in a case where the number of antennas is four.

Next, a case where the number of antennas is more than two will be described. FIG. 4A is a diagram illustrating a configuration example of antenna apparatus 3 when the number of antennas is four, and FIG. 4B is a diagram illustrating another configuration example of antenna apparatus 4 when the number of antennas is four.

Antenna apparatus 3 illustrated in FIG. 4A includes first ground plane 30*a*, second ground plane 30*b*, first antenna 31, second antenna 32, third antenna 33, and fourth antenna 34.

First ground plane 30*a* and second ground plane 30*b* are provided in parallel with each other, herein.

First antenna 31 is an inverted-L antenna and includes first element 31*a* extending perpendicularly with respect to second ground plane 30*b* of a rectangular shape, and second element 31*b* extending along a long side of second ground plane 30*b*.

Further, first antenna 31 is connected to a corner portion of second ground plane 30*b* via first power feeding point 35.

Second antenna 32 is also an inverted-L antenna and includes third element 32*a* extending perpendicularly with respect to first ground plane 30*a* on the same side as first element 31*a* of first antenna 31, and fourth element 32*b* extending along the long side of second ground plane 30*b*.

Second antenna 32 is connected via second power feeding point 36 to a corner portion of first ground plane 30*a* on the same side as the corner portion of second ground plane 30*b* where first power feeding point 35 is positioned.

Herein, a notch is formed in second ground plane 30*b* for the purpose of achieving downsizing of antenna apparatus 3 by extending third element 32*a* perpendicularly with respect to first ground plane 30*a* without causing third element 32*a* to protrude outward.

The direction in which fourth element 32*b* of second antenna 32 extends from third element 32*a* is the same as the direction in which second element 31*b* of first antenna 31 extends from first element 31*a*.

Further, second element 31*b* of first antenna 31 is provided so as to be positioned at the same height as fourth element 32*b* of second antenna 32 as viewed from second ground plane 30*b*.

Third antenna 33 is also an inverted-L antenna and includes fifth element 33*a* extending perpendicularly with respect to first ground plane 30*a* on a side opposite to a side of first element 31*a* of first antenna 31, and sixth element 33*b* extending along a long side of first ground plane 30*a*.

Third antenna 33 is connected via third power feeding point 37 to a corner portion of first ground plane 30*a* which is positioned diagonally to the corner portion of second ground plane 30*b* where second power feeding point 36 is positioned.

Fourth antenna 34 is also an inverted-L antenna and includes seventh element 34*a* extending perpendicularly with respect to second ground plane 30*b* on the side opposite to first element 31*a* of first antenna 31, and eighth element 34*b* extending along the long side of first ground plane 30*a*.

Fourth antenna 34 is connected via fourth power feeding point 38 to a corner portion of second ground plane 30*b* on the same side as the corner portion of first ground plane 30*a* where third power feeding point 37 is positioned.

Herein, a notch is formed in first ground plane 30*a* for the purpose of achieving downsizing of antenna apparatus 3 by extending seventh element 34*a* perpendicularly with respect to second ground plane 30*b* without causing seventh element 34*a* to protrude outward.

The direction in which eighth element 34*b* of fourth antenna 34 extends from seventh element 34*a* is the same as the direction in which sixth element 33*b* of third antenna 33 extends from fifth element 33*a*.

Sixth element 33*b* of third antenna 33 is provided so as to be positioned at the same height as eighth element 34*b* of fourth antenna 34 as viewed from first ground plane 30*a*.

Antenna apparatus 4 illustrated in FIG. 4B includes first ground plane 40*a*, second ground plane 40*b*, first antenna 41, second antenna 42, third antenna 43, and fourth antenna 44.

First ground plane 40*a* and second ground plane 40*b*, herein, are provided in parallel with each other.

First antenna 41 is an inverted-L antenna and includes first element 41*a* extending perpendicularly with respect to second ground plane 40*b* of a rectangular shape, and second element 41*b* extending along a long side of second ground plane 40*b*.

Further, first antenna 41 is connected to a corner portion of second ground plane 40*b* via first power feeding point 45.

Second antenna 42 is also an inverted-L antenna and includes fourth element 42*a* extending perpendicularly with respect first ground plane 40*a* on the same side as first element 41*a* of first antenna 21, and fourth element 42*b* extending along the long side of second ground plane 40*b*.

Second antenna 42 is connected via second power feeding point 46 to a corner portion of first ground plane 40*a* on the same side as the corner portion of second ground plane 40*b* where first power feeding point 45 is positioned.

Herein, a notch is formed in second ground plane 40*b* for the purpose of achieving downsizing of antenna apparatus 4 by extending third element 42*a* perpendicularly with respect to first ground plane 40*a* without causing third element 42*a* to protrude outward.

The direction in which fourth element 42*b* of second antenna 42 extends from third element 42*a* is the same as the direction in which second element 41*b* of first antenna 41 extends from first element 41*a*.

Further, second element 41*b* of first antenna 41 is provided so as to be positioned at the same height as fourth element 42*b* of second antenna 42 as viewed from second ground plane 40*b*.

Third antenna 43 is also an inverted-L antenna and includes fifth element 43*a* extending perpendicularly with respect to first ground plane 40*a* on a side opposite to first element 41*a* of first antenna 41, and sixth element 43*b* extending along a long side of first ground plane 40*a*.

Third antenna 43 is connected via third power feeding point 47 to a corner portion of second ground plane 40*b* which is positioned diagonally to the corner portion of first ground plane 40*a* where second power feeding point 46 is positioned.

Herein, a notch is formed in first ground plane 40*a* for the purpose of achieving downsizing of antenna apparatus 4 by extending fifth element 43*a* perpendicularly with respect to second ground plane 40*b* without causing fifth element 43*a* to protrude outward.

Fourth antenna 44 is also an inverted-L antenna and includes seventh element 44*a* extending perpendicularly with respect to first ground plane 40*a* on a side opposite to a side of first element 41*a* of first antenna 41, and eighth element 44*b* extending along the long side of first ground plane 40*a*.

Fourth antenna 44 is connected via fourth power feeding point 48 to a corner portion of first ground plane 40*a* on the same side as the corner portion of second ground plane 40*b* where third power feeding point 47 is positioned.

The direction in which eighth element 44*b* of fourth antenna 44 extends from seventh element 44*a* is the same as the direction in which sixth element 43*b* of third antenna 43 extends from fifth element 43*a*.

Sixth element 43*b* of third antenna 43 is provided so as to be positioned at the same height as eighth element 44*b* of fourth antenna 44 as viewed from first ground plane 40*a*.

In antenna apparatuses 3 and 4 illustrated in FIGS. 4A and 4B, the symmetry of the current distributions and the radiation patterns of antenna apparatuses 3 and 4 is broken as in the case of antenna apparatus 2 illustrated in FIG. 1B. Therefore, the correlation coefficients and the efficiency of the antennas are remarkably improved.

In the above embodiment, for the purpose of downsizing antenna apparatuses 2 to 4, the notches are formed in the ground planes and the antenna elements are caused to pass through the notches, but the notches need not necessarily be provided as long as a required amount of downsizing is achieved.

Figure 5:
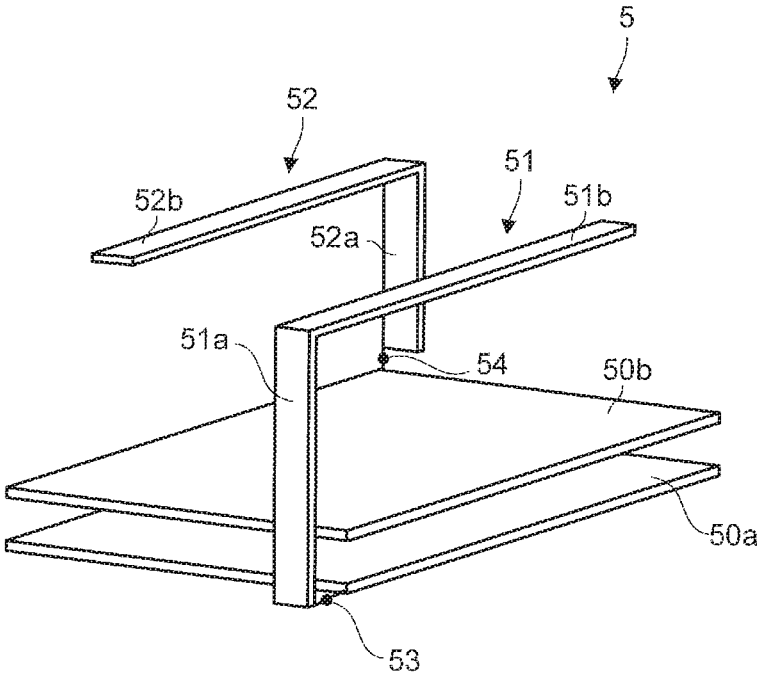
FIG. 5 is a diagram illustrating a configuration example of an antenna apparatus in which no notch is provided in a second ground plane in a case where the first ground plane and the second ground plane are present.

FIG. 5 is a diagram illustrating a configuration example of antenna apparatus 5 in which no notch is provided in second ground plane 50*b* in a case where first ground plane 50*a* and second ground plane 50*b* are present.

Antenna apparatus 5 includes first ground plane 50*a*, second ground plane 50*b*, first antenna 51, and second antenna 52.

First ground plane 50*a* and second ground plane 50*b*, herein, are provided in parallel with each other.

First antenna 51 is an inverted-L antenna and includes first element 51*a* extending perpendicularly with respect to first ground plane 50*a* of a rectangular shape, and second element 51*b* extending along a long side of first ground plane 50*a*.

First antenna 51 is connected to a corner portion of first ground plane 50*a* via first power feeding point 53.

However, unlike antenna apparatus 2 illustrated in FIG. 1B, second ground plane 50*b* does not have a notch through which first element 51*a* is caused to pass, and first element 51*a* passes an outer side of second ground plane 50*b* and extends perpendicularly with respect to first ground plane 50*a*.

Second antenna 52 is also an inverted-L antenna and includes third element 52*a* extending perpendicularly with respect to first ground plane 50*a* on the same side as first element 51*a* of first antenna 51, and fourth element 52*b* extending along a long side of second ground plane 50*b*.

Second antenna 52 is connected via second power feeding point 54 to a corner portion of second ground plane 50*b* which is positioned diagonally to the corner portion of first ground plane 50*a* where first power feeding point 53 is positioned.

The direction in which fourth element 52*b* of second antenna 52 extends from third element 52*a* is substantially opposite to the direction in which second element 51*b* of first antenna 51 extends from first element 51*a*.

Second element 51*b* of first antenna 51 is provided so as to be positioned at the same height as fourth element 52*b* of second antenna 52 as viewed from second ground plane 50*b*.

In this case, as in the case of antenna apparatus 2 illustrated in FIG. 1B, the symmetry of the current distributions and the radiation patterns of antenna apparatus 5 is broken. Therefore, the correlation coefficient and the efficiency of the antenna are remarkably improved.

In the embodiment described above, the description has been given with an inverted-L antenna in which an element is partly bent (may be referred to as "partly-bent element" hereinafter), as an example, but the technical scope of the present disclosure is not limited to the inverted-L antenna, and may be, for example, a monopole antenna, a loop antenna, or another linear antenna or a dipole antenna, and is not particularly limited.

The antenna apparatus according to the present disclosure further includes a third antenna, in which the third antenna is connected to the first ground plane via a third power feeder, and in which the third antenna is provided on a side of the first ground plane and the second ground plane which is opposite to a side of the first antenna and the second antenna.

The antenna apparatus according to the present disclosure further includes a fourth antenna, in which the fourth antenna is connected to the second ground plane via a fourth power feeder, and in which the fourth antenna is provided on a side of the first ground plane and the second ground plane which is opposite to a side of the first antenna and the second antenna.

In the antenna apparatus according to the present disclosure, the second ground plane includes a notch through which the first antenna passes.

The antenna apparatus according to the present disclosure further includes a third antenna and a fourth antenna, in which the third antenna is connected to the first ground plane via a third power feeder, and the fourth antenna is connected to the second ground plane via a fourth power feeder, and in which the third antenna and the fourth antenna are provided on a side of the first ground plane and the second ground plane which is opposite to a side of the first antenna and the second antenna.

In the antenna apparatus according to the present disclosure, the third antenna is connected to another corner portion of the first ground plane positioned diagonally to the corner portion of the first ground plane where the second antenna is connected, and in which the fourth antenna is connected to a corner portion of the second ground plane positioned diagonally to a corner portion of the second ground plane where the first antenna is connected.

In the antenna apparatus according to the present disclosure, the third antenna and the fourth antenna each include a partly-bent element.

In the antenna apparatus according to the present disclosure, a portion of the partly-bent element in the third antenna and a portion of the partly-bent element of the fourth antenna extend in a same direction.

In the antenna apparatus according to the present disclosure, the first ground plane includes, at a corner portion of the first ground plane, a notch through which the fourth antenna passes.

The antenna apparatus according to the present disclosure further includes a third antenna and a fourth antenna, in which the third antenna is connected to the second ground plane via a third power feeder, and the fourth antenna is connected to the first ground plane via a fourth power feeder, and in which the third antenna and the fourth antenna are provided on a side of the first ground plane and the second ground plane which is opposite to a side of the first antenna and the second antenna.

In the antenna apparatus according to the present disclosure, the third antenna is connected to a corner portion of the second ground plane positioned diagonally to the corner portion of the first ground plane where the second antenna is connected, and in which the fourth antenna is connected to a corner portion of the first ground plane positioned diagonally to the corner portion of the second ground plane where the first antenna is connected.

In the antenna apparatus according to the present disclosure, the third antenna and the fourth antenna each include a partly-bent element.

In the antenna apparatus according to the present disclosure, a portion of the partly-bent element in the third antenna and a portion of the partly-bent element of the fourth antenna extend in a same direction.

In the antenna apparatus according to the present disclosure, the first ground plane includes, at a corner portion of the first ground plane, a notch through which the third antenna passes.

While various embodiments have been described herein above, it is to be appreciated that various changes in form and detail may be made without departing from the sprit and scope of the invention(s) presently or hereafter claimed.

This application is entitled to and claims the benefit of Japanese Patent Application No. 2019-064965, filed on Mar. 28, 2019, the disclosure of which including the specification, drawings and abstract is incorporated herein by reference in its entirety.

INDUSTRIAL APPLICABILITY

The antenna apparatus according to the present disclosure is suitable for applications to antenna apparatuses for performing communication using a plurality of antennas.

REFERENCE SIGNS LIST

1, 2, 3, 4, 5 Antenna apparatus
10 Ground plane
20*a*, 30*a*, 40*a*, 50*a* First ground plane
20*b*, 30*b*, 40*b*, 50*b* Second ground plane
11, 21, 31, 41, 51 First antenna
11*a*, 21*a*, 31*a*, 41*a*, 51*a* First element
11*b*, 21*b*, 31*b*, 41*b*, 51*b* Second element
12, 22, 32, 42, 52 Second antenna
12*a*, 22*a*, 32*a*, 42*a*, 52*a* Third element
12*b*, 22*b*, 32*b*, 42*b*, 52*b* Fourth element
13, 23, 35, 45, 53 First power feeding point
14, 24, 36, 46, 54 Second power feeding point
33, 43 Third antenna
33*a*, 43*a* Fifth element
33*b*, 43*b* Sixth element
34, 44 Fourth antenna
34*a*, 44*a* Seventh element
34*b*, 44*b* Eighth element
37, 47 Third power feeding point
38, 48 Fourth power feeding point

The invention claimed is:

1. An antenna apparatus, comprising:
a first antenna;
a second antenna;
a third antenna;
a fourth antenna;
a first ground plane to which the first antenna is connected via a first power feeder; and
a second ground plane to which the second antenna is connected via a second power feeder,
wherein the second antenna is provided on a same side as the first antenna with respect to the first ground plane,
wherein the first ground plane and the second ground plane are provided substantially in parallel with each other and in a state where the first ground plane and the second ground plane are not physically connected directly, nor indirectly, with each other,
wherein the third antenna is connected to the first ground plane via a third power feeder, and the fourth antenna is connected to the second ground plane via a fourth power feeder, and
wherein the third antenna and the fourth antenna are provided on a side of the first ground plane and the second ground plane which is opposite to a side of the first antenna and the second antenna.

2. The antenna apparatus according to claim 1,
wherein the first antenna is an antenna to be connected to a corner portion of the first ground plane, and the second antenna is an antenna to be connected to a corner portion of the second ground plane, the corner portion of the second ground plane being positioned diagonally to the corner portion of the first ground plane.

3. The antenna apparatus according to claim 2,
wherein the first antenna and the second antenna each include a partly-bent element.

4. The antenna apparatus according to claim 3,
wherein a portion of the partly-bent element in the first antenna and a portion of the partly-bent element of the second antenna extend in directions substantially opposite to each other.

5. The antenna apparatus according to claim 2,
wherein the second ground plane includes, at another corner portion of the second ground plane positioned diagonally to the corner portion of the second ground plane, a notch through which the first antenna passes.

6. The antenna apparatus according to claim 3,
wherein a distance between the first ground plane and the second ground plane is equal to or greater than 2 mm and is not greater than (16−2t/5) mm in a case where the first ground plane and the second ground plane are each a rectangular ground plane, and a length of a long side of each of the first ground plane and the second ground plane is equal to or greater than 70 mm and is not greater than 90 mm, and a length of a short side of each of the first ground plane and the second ground plane is (25+t) mm, where t is equal to or greater than 10 and is not greater than 20.

7. The antenna apparatus according to claim 1,
wherein the second ground plane includes a notch through which the first antenna passes.

8. The antenna apparatus according to claim 1,
wherein the third antenna is connected to another corner portion of the first ground plane positioned diagonally to the corner portion of the first ground plane where the second antenna is connected, and wherein the fourth antenna is connected to a corner portion of the second ground plane positioned diagonally to a corner portion of the second ground plane where the first antenna is connected.

9. The antenna apparatus according to claim 1, wherein the third antenna and the fourth antenna each include a partly-bent element.

10. The antenna apparatus according to claim 9, wherein a portion of the partly-bent element in the third antenna and a portion of the partly-bent element of the fourth antenna extend in a same direction.

11. The antenna apparatus according to claim 1, wherein the first ground plane includes, at a corner portion of the first ground plane, a notch through which the fourth antenna passes.

12. An antenna apparatus, comprising:

a first antenna;

a second antenna;

a third antenna; and a fourth antenna, a first ground plane to which the first antenna is connected via a first power feeder; and a second ground plane to which the second antenna is connected via a second power feeder, wherein the second antenna is provided on a same side as the first antenna with respect to the first ground plane, wherein the first ground plane and the second ground plane are provided substantially in parallel with each other and in a state where the first ground plane and the second ground plane are not physically connected directly, nor indirectly, with each other, wherein the third antenna is connected to the second ground plane via a third power feeder, and the fourth antenna is connected to the first ground plane via a fourth power feeder, and wherein the third antenna and the fourth antenna are provided on a side of the first ground plane and the second ground plane which is opposite to a side of the first antenna and the second antenna.

13. The antenna apparatus according to claim 12, wherein the third antenna is connected to a corner portion of the second ground plane positioned diagonally to the corner portion of the first ground plane where the second antenna is connected, and wherein the fourth antenna is connected to a corner portion of the first ground plane positioned diagonally to the corner portion of the second ground plane where the first antenna is connected.

14. The antenna apparatus according to claim 12, wherein the third antenna and the fourth antenna each include a partly-bent element.

15. The antenna apparatus according to claim 14, wherein a portion of the partly-bent element in the third antenna and a portion of the partly-bent element of the fourth antenna extend in a same direction.

16. The antenna apparatus according to claim 12, wherein the first ground plane includes, at a corner portion of the first ground plane, a notch through which the third antenna passes.

* * * * *